US011778381B2

(12) United States Patent
Zhu et al.

(10) Patent No.: US 11,778,381 B2
(45) Date of Patent: Oct. 3, 2023

(54) SOUND-PRODUCING STRUCTURE AND PLAYBACK DEVICE

(71) Applicant: Beijing Xiaomi Mobile Software Co., Ltd., Beijing (CN)

(72) Inventors: Yong Zhu, Beijing (CN); Lingyun Wen, Beijing (CN); Guang Xu, Beijing (CN)

(73) Assignee: Beijing Xiaomi Mobile Software Co., Ltd, Beijing (CN)

( * ) Notice: Subject to any disclaimer, the term of this patent is extended or adjusted under 35 U.S.C. 154(b) by 0 days.

(21) Appl. No.: 17/708,602

(22) Filed: Mar. 30, 2022

(65) Prior Publication Data

US 2023/0040924 A1 Feb. 9, 2023

(30) Foreign Application Priority Data

Aug. 9, 2021 (CN) ..... 202121852648.3

(51) Int. Cl.
*H04R 5/02* (2006.01)
*H04R 1/02* (2006.01)
*H04R 9/02* (2006.01)

(52) U.S. Cl.
CPC ..... *H04R 5/02* (2013.01); *H04R 1/025* (2013.01); *H04R 1/026* (2013.01); *H04R 1/028* (2013.01); *H04R 9/022* (2013.01)

(58) Field of Classification Search
CPC ..... H04R 5/02; H04R 1/025; H04R 1/026; H04R 1/028; H04R 9/022
See application file for complete search history.

(56) References Cited

U.S. PATENT DOCUMENTS

| | | | | |
|---|---|---|---|---|
| 11,553,265 | B2 * | 1/2023 | Wodrich | H04R 1/04 |
| 2016/0345086 | A1 | 11/2016 | Chamberlin et al. | |
| 2020/0304914 | A1 * | 9/2020 | Mata Magana | F21V 33/0056 |
| 2021/0099779 | A1 * | 4/2021 | Tang | G06F 1/20 |
| 2021/0144277 | A1 * | 5/2021 | Cheng | H04R 1/028 |
| 2022/0109222 | A1 * | 4/2022 | Heckmann | H05K 7/20509 |

FOREIGN PATENT DOCUMENTS

| | | | |
|---|---|---|---|
| CN | 107295441 | A | 10/2017 |
| CN | 211831599 | U | 10/2020 |
| EP | 3806492 | A1 | 4/2021 |

OTHER PUBLICATIONS

Partial European Search Report dated Sep. 28, 2022 for European Patent Application No. 22165207.6.
Extended European Search Report dated Feb. 7, 2023 for European Patent Application No. 22165207.6.

* cited by examiner

*Primary Examiner* — Andrew L Sniezek
(74) *Attorney, Agent, or Firm* — Volpe Koenig

(57) ABSTRACT

A sound-producing structure includes: a hollow piece; a sound-producing piece located in a hollow cavity of the hollow piece; and a heat dissipation piece located outside the hollow cavity, a first part of the heat dissipation piece being located below the hollow piece and a second part of the heat dissipation piece being on a side wall of the hollow piece.

9 Claims, 9 Drawing Sheets

SOUND-PRODUCING STRUCTURE AND PLAYBACK DEVICE

CROSS REFERENCE TO RELATED APPLICATION

The present application claims the benefit of priority to Chinese Application No. 202121852648.3, filed on Aug. 9, 2021, the contents of which are incorporated herein by reference in their entireties for all purposes.

BACKGROUND

A speaker is an instance of playback devices. At present, speakers are developed towards a direction of design with exquisite appearance and diversified functions. While functional diversity leads to a compact internal space of the speaker, it also results in an increase of heat-generating components.

SUMMARY

The disclosure relates to the technical field of electronics, in particular to a sound-producing structure and a playback device.

According an embodiment of a first aspect of the disclosure, a sound-producing structure is provided and includes: a hollow piece; a sound-producing piece located in a hollow cavity of the hollow piece; and a heat dissipation piece located outside the hollow cavity. A first part of the heat dissipation piece is located below the hollow piece and a second part of the heat dissipation piece is installed on a side wall of the hollow piece.

According an embodiment of a second aspect of the disclosure, a playback device is provided and includes: the sound-producing structure according to the embodiment of the first aspect; and a bracket, located below a heat dissipation piece of the sound-producing structure. A hollow piece of the sound-producing structure is installed on the bracket.

It can be understood that the foregoing general description and the following detailed description are explanatory, and are not intended to limit the disclosure.

BRIEF DESCRIPTION OF THE DRAWINGS

The accompanying drawings herein, which are incorporated in and constitute a part of this specification, illustrate embodiments consistent with the disclosure and together with the specification serve to explain the principles of the disclosure.

DETAILED DESCRIPTION

The embodiments will be described in detail herein, instances of which are illustrated in the accompanying drawings. When the following description refers to the accompanying drawings, the same numbers in different drawings represent the same or similar elements unless otherwise indicated. The implementations described in the following embodiments do not represent all implementations consistent with the disclosure. On the contrary, they are merely instances of an apparatus and a method consistent with some aspects of the disclosure as detailed in the appended claims.

It should be understood that the term "one element (structure or component) is on another element (structure or component)" should be construed in a broad sense, for example, the one element may by directly disposed on the another element or indirectly disposed on the another element through an Intermediate element, and the one element may be right above the another element or obliquely above the another element, and the two elements may be in contact, connected or integrated.

At present, speakers are developed towards a direction of design with exquisite appearance and diversified functions. While functional diversity leads to a compact internal space of the speaker, it also results in an increase of heat-generating components. The increased heat-generating components cause an excessively high temperature of a whole machine and hence an influence on performance of the speaker. Therefore, heat dissipation needs to be performed on heat-generating components with relatively high power consumption, so as to reduce the influence of the heat-generating components on performance of the speaker caused by the excessively high temperature.

Figure 1:
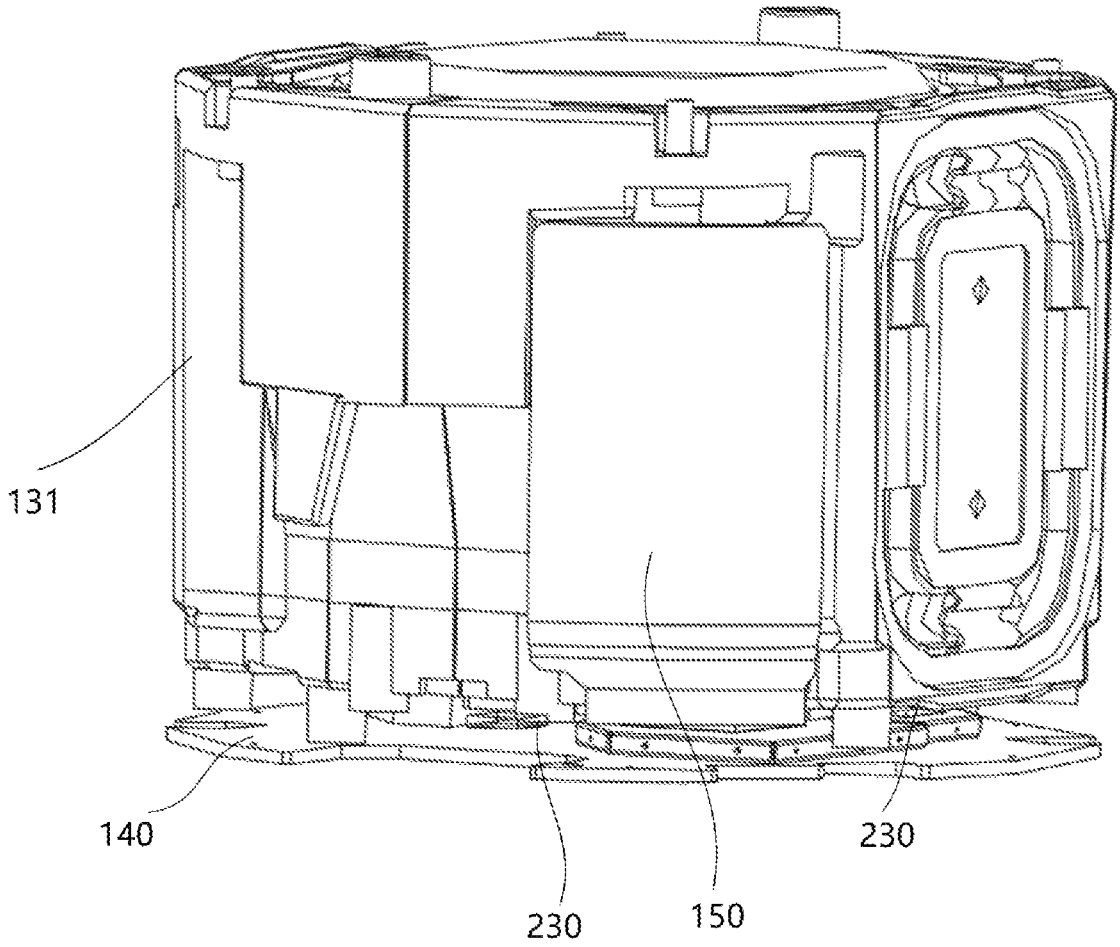
FIG. 1 is a schematic structural diagram of a sound-producing structure illustrated according to an embodiment.

FIG. 1 illustrates a schematic structural diagram of a sound-producing structure. As shown in FIG. 1, an embodiment of a first aspect of the disclosure provides a sound-producing structure, including: a hollow piece 131; a sound-producing piece, located in a hollow cavity 130 (shown in FIG. 7) of the hollow piece 131; and a heat dissipation piece 150, located outside the hollow cavity 130. A first part 151 (shown in FIG. 2) of the heat dissipation piece 150 is located below the hollow piece 131 and a second part 152 (shown in FIG. 2) of the heat dissipation piece 150 is installed on a side wall of the hollow piece 131.

In the embodiment of the present disclosure, the first part 151 of the heat dissipation piece 150 can transfer the heat generated by the heat-generating components 250 to the second part 152 of the heat dissipation piece 150 for heat dissipation. Therefore the influence of the heat-generating components 250 on the performance of the sound-producing structure due to excessive temperature is reduced. The second part 152 of the heat dissipation piece 150 is located outside the side wall of the hollow piece 131, so that the heat dissipation piece 150 can transfer the heat generated by the heat-generating components 250 to the side of the side wall of the hollow piece 131. Therefore, gathering of the heat below the heat dissipation piece 150 is reduced and a heat dissipation space of the heat dissipation piece 150 is increased, thus further improving heat dissipation efficiency.

Without limitation, the sound-producing piece includes a loudspeaker.

Figure 2:
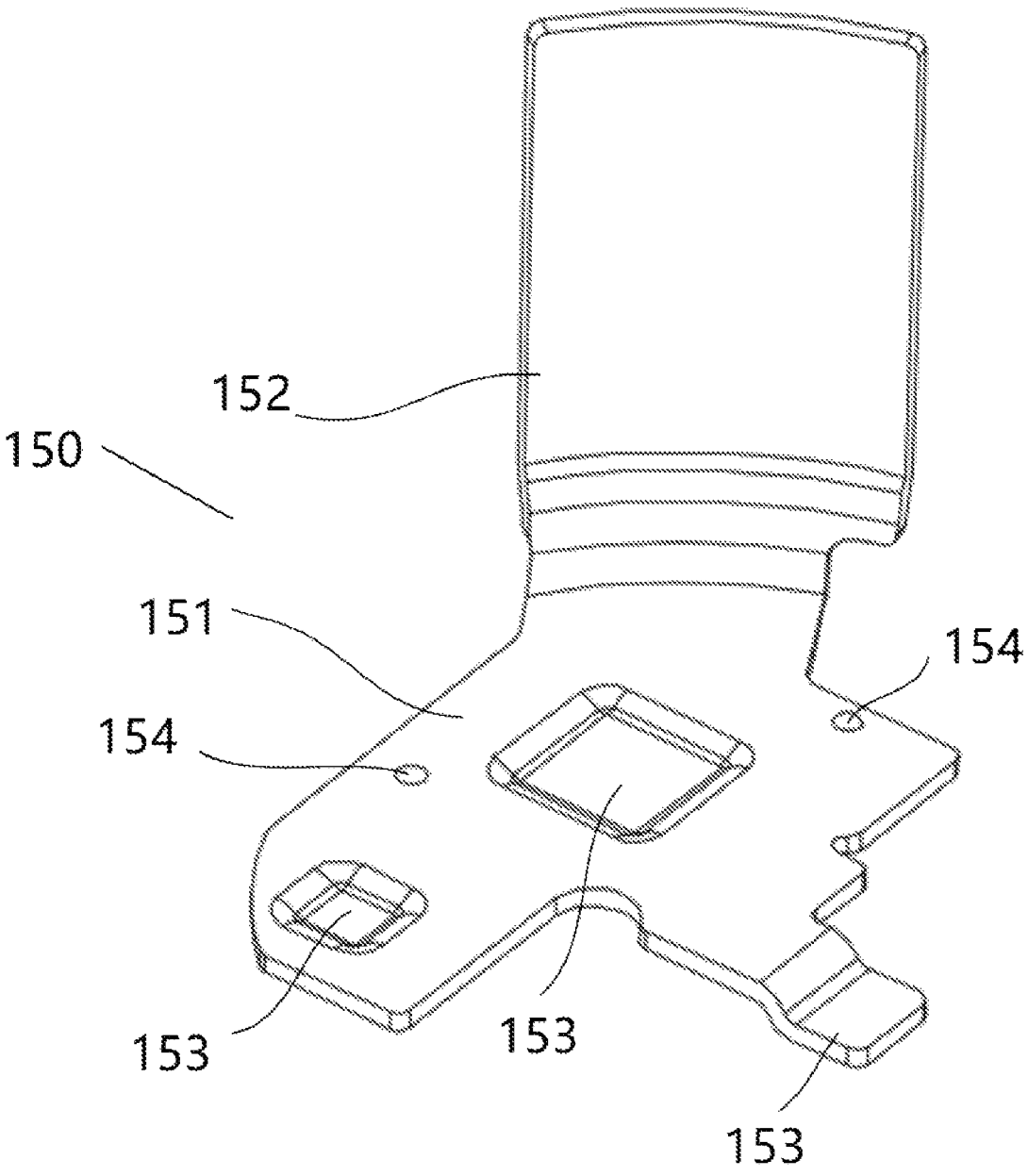
FIG. 2 is a schematic structural diagram of a heat dissipation piece in a playback device illustrated according to an embodiment.
Figure 3:
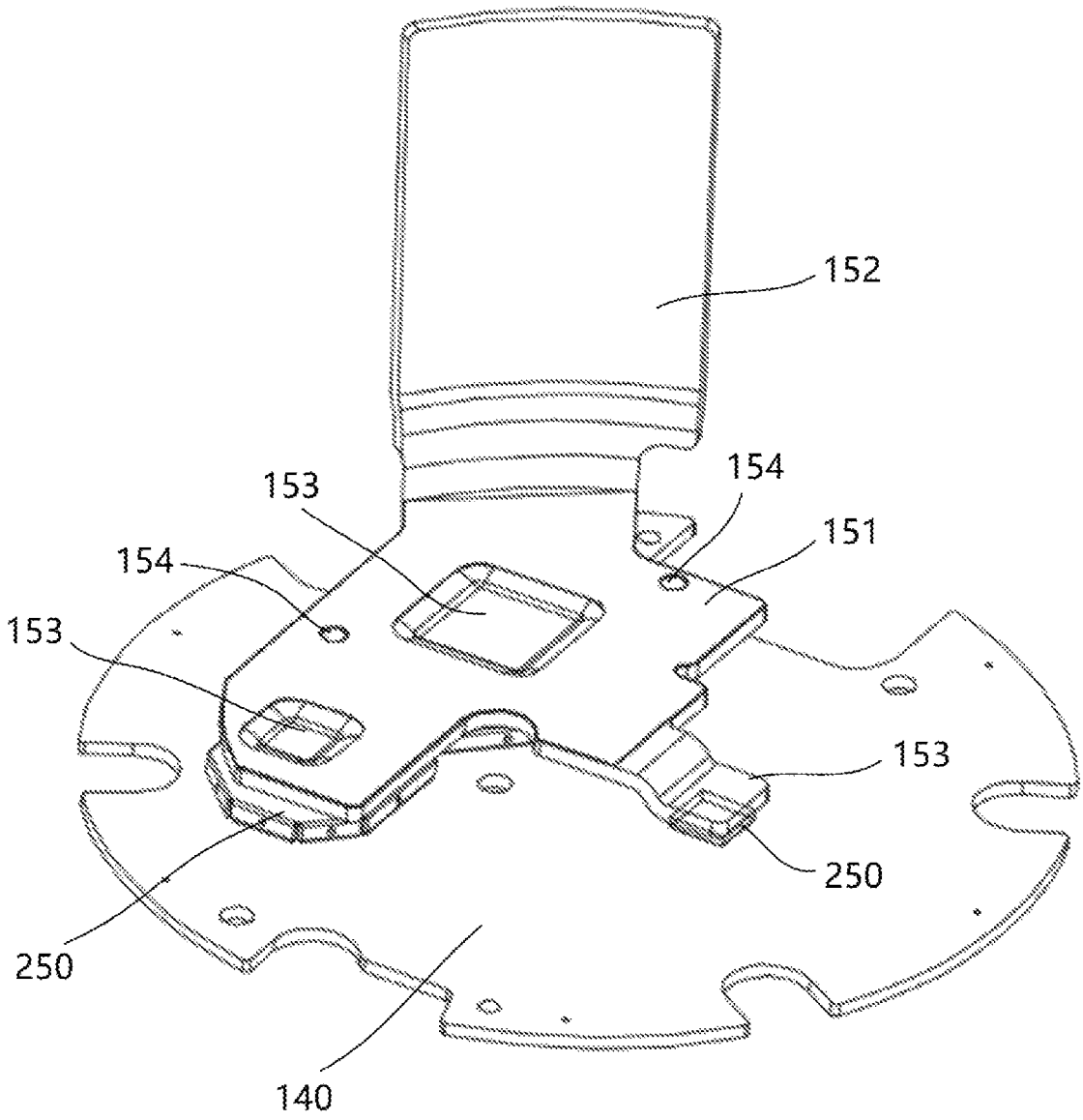
FIG. 3 is a first schematic structural diagram of a connection among a heat dissipation piece, a heat source seat and a heat-generating component in a playback device illustrated according to an embodiment.

In general, heat-generating components 250 are located below the first part 151 of the heat dissipation piece 150. Normally a plurality of heat-generating components 250 are included, so a space below the heat dissipation piece 150 is relatively congested. As shown in FIG. 1 to FIG. 3, the first part 151 of the heat dissipation piece 150 is utilized to absorb heat generated by the heat-generating components 250, and the second part 152 of the heat dissipation piece 150 transfers the heat to the position of the side wall of the hollow piece 131 for heat dissipation. Therefore, gathering of the heat below the heat dissipation piece 150 is reduced and a heat dissipation space of the heat dissipation piece 150 is increased, thus further improving heat dissipation efficiency.

Without limitation, the heat dissipation piece 150 may be in a sheet shape formed by bending. For instance: the first part 151 and the second part 152 are roughly perpendicular to each other. As shown in FIG. 1 to FIG. 3, the heat dissipation piece 150 is roughly in an L shape, which is an example that is not intended to limit the disclosure.

A material of the heat dissipation piece 150 may be a metal or alloy material with a relatively good heat dissipation effect.

In some other embodiments, as shown in FIG. 1 to FIG. 3, the structure further includes: a heat source seat 140, located below the hollow piece 131; and the heat-generating components 250, installed on the heat source seat 140. The first part 151 of the heat dissipation piece 150 is installed on the heat source seat 140.

In general, the plurality of heat-generating components 250 are included, so the space below the heat source seat 140 is relatively congested. As shown in FIG. 3, the first part 151 of the heat dissipation piece 150 is installed on the heat source seat 140, so as to absorb heat generated by a heat source, and the second part 152 of the heat dissipation piece 150 is located at the side wall of the hollow piece 131. Occupation by the heat dissipation piece 150 of a limited space on the heat source seat 140 is reduced, and a space above the heat source seat 140 in the sound-producing structure is fully utilized.

Without limitation, as shown in FIG. 3, the heat dissipation piece 150 covers the heat-generating components 250, i.e. the heat-generating components 250 are located between the heat dissipation piece 150 and the heat source seat 140.

In some embodiments, as shown in FIG. 2 and FIG. 3, the heat dissipation piece 150 has a plurality of first positioning holes 154, and a position on the heat source seat 140 in alignment with the first positioning holes 154 has second positioning holes. A device further includes screws that penetrate through the first positioning holes 154 and the second positioning holes. The screws are used to fix the heat dissipation piece 150 on the heat source seat 140. Alternatively, double faced adhesive tape may also be used to fix the heat dissipation piece 150 on the heat source seat 140, which is an example that is not intended to limit the disclosure.

The material of the heat dissipation piece 150 may be a metal or alloy material with the relatively good heat dissipation effect.

As shown in FIG. 3, the heat-generating components 250 includes but are not limited to a WiFi chip, a PA (power amplifier) chip, a master chip, etc. The master chip may include a processor, a memory or a circuit board, etc.

In practical application, the sound-producing structure further includes shielding cases. The shielding cases cover outside the heat-generating components 250, so as to perform electromagnetic shielding on the heat-generating components 250, thus ensuring performance of the heat-generating components 250.

In some other embodiments, the heat dissipation piece 150 has bosses 153 protruding towards the heat-generating components 250.

As shown in FIG. 2 and FIG. 3, the bosses 153 are aligned with the heat-generating components 250, and reduce distances between the heat dissipation piece 150 and the heat-generating components 250, thus improving a heat dissipation effect of the heat dissipation piece 150 to the heat-generating components 250.

For the plurality of heat-generating components 250 distributed at interval, the quantity of the bosses 153 is equal to the quantity of the heat-generating components 250, and a protruding height of each boss 153 may be determined according to a distance between a corresponding position of the heat dissipation piece 150 and the corresponding heat-generating component 250, so as to further ensure the heat dissipation effect to each heat-generating component 250.

In some other embodiments, the structure further includes heat conducting glue 230, the heat conducting glue is located between the bosses 153 and the heat source seat 140.

Figure 4:
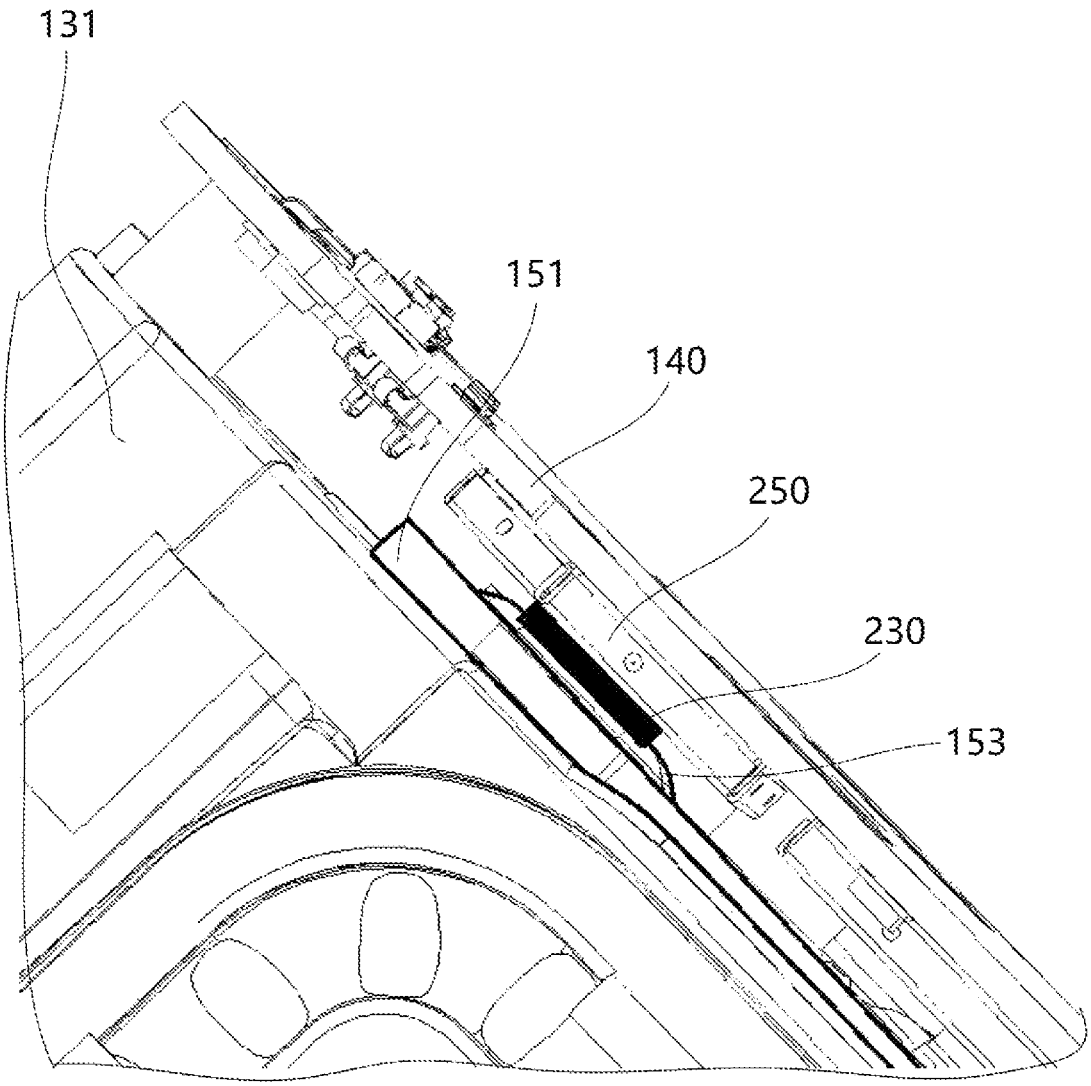
FIG. 4 is a second schematic structural diagram of a connection among a heat dissipation piece, a heat source seat and a heat-generating component in a playback device illustrated according to an embodiment.

As shown in FIG. 4, a heat conducting glue 230 can fill seams between the heat-generating components 250 and the bosses 153 and conduct the heat generated by the heat-generating components 250 to the heat dissipation piece 150 in a faster way, thus to further improve the heat dissipation effect.

The heat conducting glue 230 may be heat conducting silica gel, which is an example that is not intended to limit the disclosure.

It can be understood that, when the heat conducting glue 230 is arranged, the bosses 153 may make contact with the heat-generating components 250 indirectly through the heat conducting glue 230; and when the heat conducting glue 230 is not arranged, the bosses 153 may make contact with the heat-generating components 250 directly.

When the shielding cases are arranged outside the heat-generating components 250, the heat conducting glue 230 is located between the shielding cases and the bosses 153. The heat is transferred to the shielding cases by the heat-generating components 250, is then transferred to the heat conducting glue 230, and is further transferred to the heat dissipation piece 150 through the heat conducting glue 230 for dissipation.

In some other embodiments, the structure further includes a top cover 132. The top cover 132 is installed above the hollow piece 131 and covers the hollow cavity 130.

Figure 9:
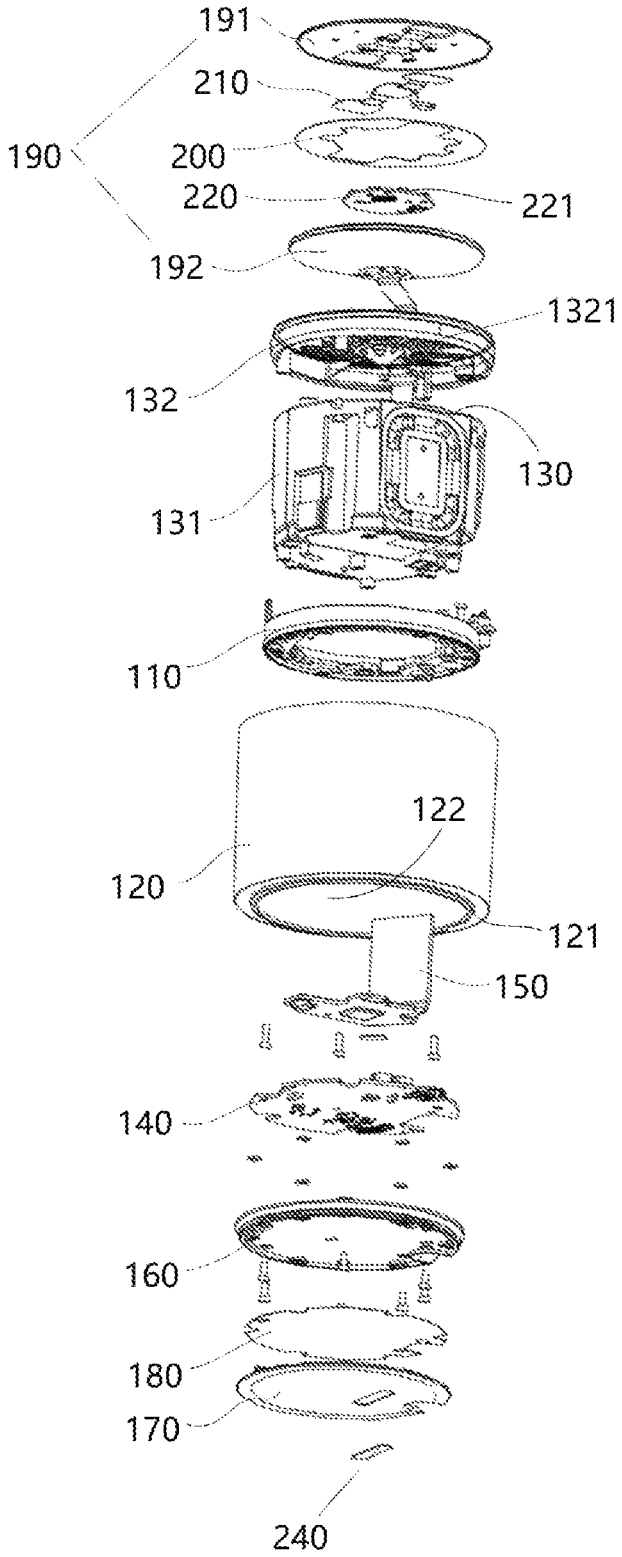
FIG. 9 is an exploded view of a playback device illustrated according to an embodiment.

With reference to FIG. 9, the top cover 132 may perform a certain sealing effect on the hollow cavity 130 and prevent dust and the like from entering the hollow cavity 130, so as to ensure a sound-producing effect.

Without limitation, a sound emitting hole 1321 may be formed in the top cover 132, and a sound emitted by the sound-producing piece is transmitted through the sound emitting hole 1321.

An embodiment of a second aspect of the disclosure provides a playback device. As shown in FIG. 9, the device includes: the sound-producing structure according to the embodiment of the first aspect; and a bracket 110 located below a heat dissipation piece 150 of the sound-producing structure. A hollow piece 131 of the sound-producing structure is installed on the bracket 110.

The playback device includes but is not limited to a speaker, a projector, an intelligent service robot, etc.

Figure 7:
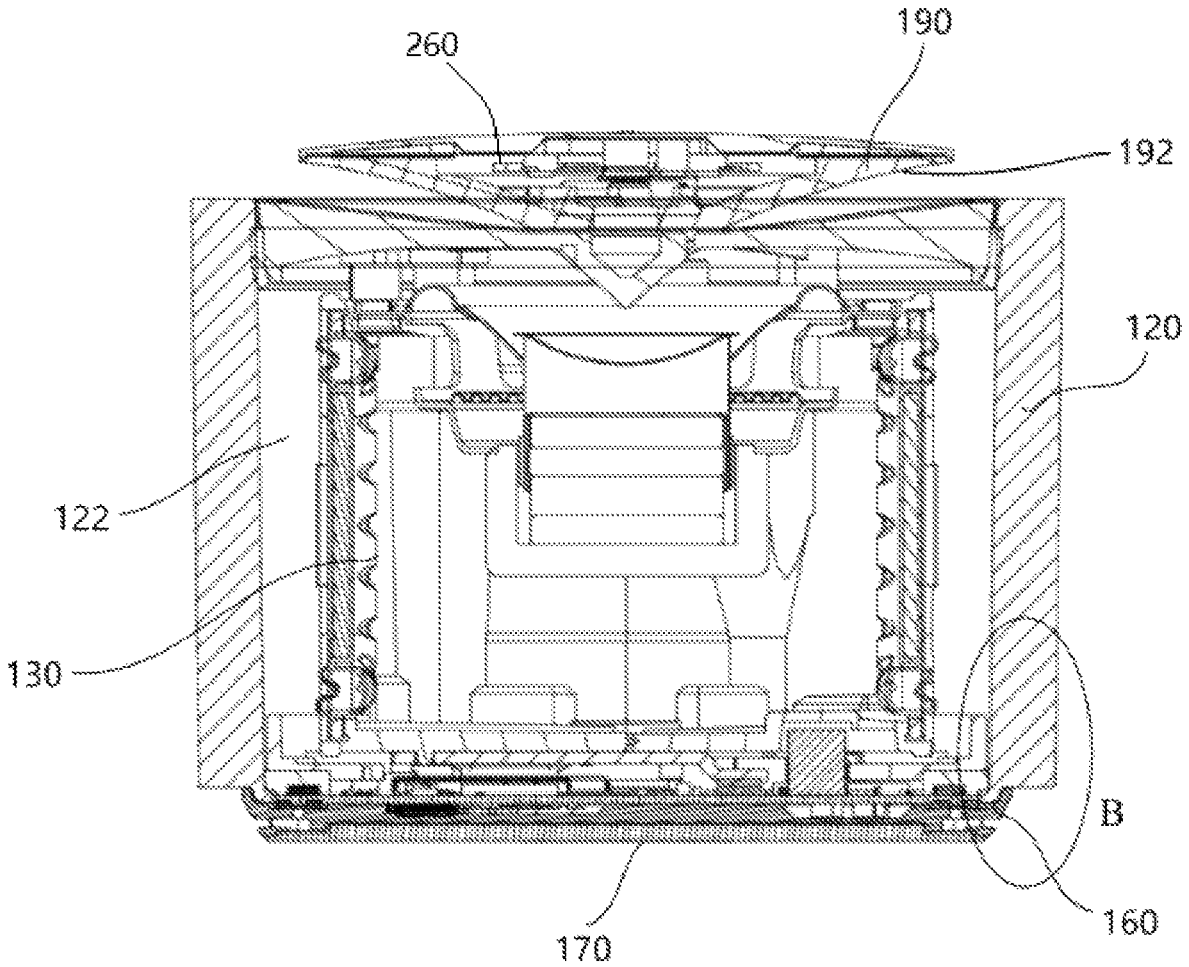
FIG. 7 is a section view of the playback device in FIG. 5 in an A-A direction.
Figure 8:
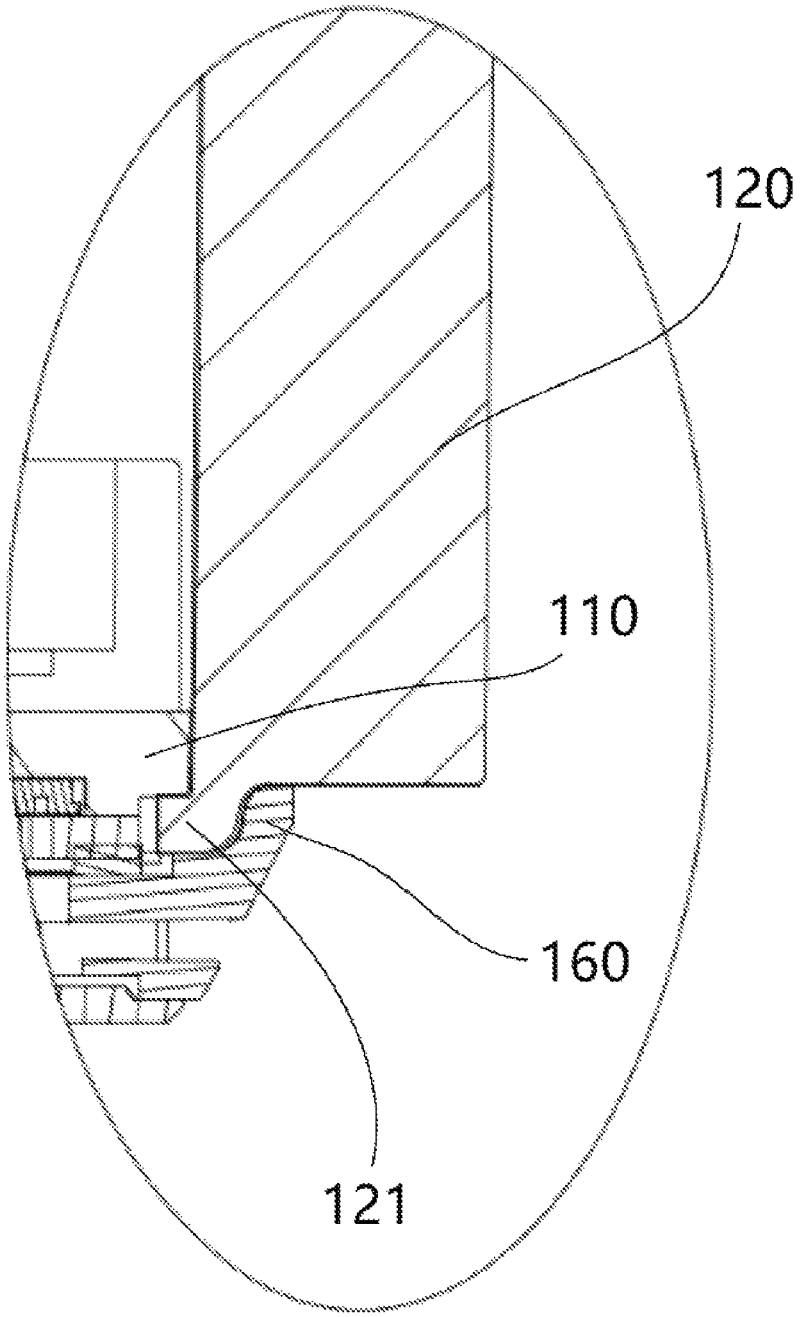
FIG. 8 is an enlarged view of part B in FIG. 7.

As shown in FIG. 7 to FIG. 9, the bracket has a supporting effect to the sound-producing structure, and can connect the sound-producing structure and other components in the playback device into an integral structure.

In some other embodiments, the device further includes a shell 120 installed on the bracket 110, where the shell 120 has a cavity 122. The hollow piece 131 is located in the cavity 122. A second part 152 of the heat dissipation piece 150 is located between the hollow piece 131 and an inner wall of the shell 120.

As shown in FIG. 9, when the playback device is used, the shell 120 is located on an upper side, and a heat-generating component 250 and a heat source seat 140 are located on a lower side. The heat-generating component 250 located on the lower side needs heat dissipation more. The heat dissipation piece 150 is used to perform heat dissipation on heat generated by the heat-generating component 250 located on the heat source seat 140, and an influence of the heat-generating component 250 on performance of the playback device caused by an excessively high temperature is reduced.

As shown in FIG. 9, an outer side of the shell 120 is an external environment, and the heat dissipation piece 150 is at least partially located between the hollow piece 131 and the inner wall of the shell 120. Therefore, a space of the cavity 122 in the shell 120 may be fully utilized, and the heat dissipation piece 150 is closer to the external environment, which is more conducive to transferring the heat to the external environment and improving a heat dissipation effect.

A sectional shape of the shell 120 may be at least one of the following: circular, square, oval, semicircular, etc., and are examples that are not intended to limit the disclosure.

In other optional embodiments, the device further includes a bottom cover 160, the bottom cover 160 and the bracket 110 are located on both sides of the heat source seat 140 respectively. A side face of the bottom cover 160 has a sound reception hole.

The heat-generating component at least includes an audio collecting module configured to collect the sound passing the sound reception hole.

Figure 5:
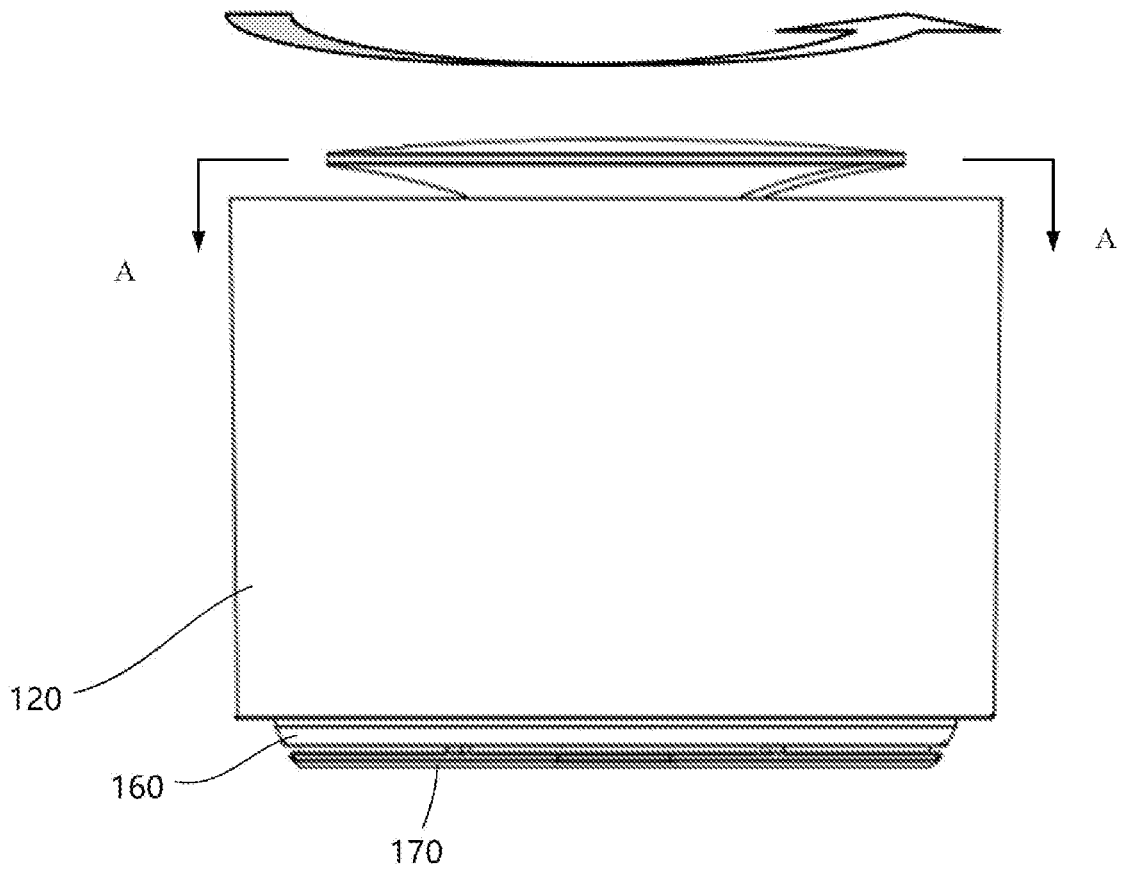
FIG. 5 is a first schematic structural diagram of a playback device illustrated according to an embodiment.

As shown in FIG. 5, the bottom cover 160 has a shielding effect and a protective effect on the heat source seat 140, and prevents the heat-generating component 250 on the heat source seat 140 from being damaged.

The bottom cover 160 is connected with the bracket 110. Without limitation, the bottom cover 160 may realize a physical connection with the bracket 110 through a bolt, thus ensuring stability of the integral structure of the playback device.

The audio collecting module may be located between the bottom cover 160 and the heat source seat 140, so the bottom cover 160 also has a protective effect on the audio collecting module.

The sound reception hole is formed in the side face of the bottom cover 160, which does not affect collection of the sound and is conducive to hiding of the sound reception hole, thus improving compactness of an appearance of the device.

The audio collecting module includes but is not limited to an audio collecting control circuit.

The sound reception hole and the audio collecting module are located at a bottom of the device, so the audio collecting module as one of heat-generating components is gathered at the heat source seat 140. Therefore, separation of the heat-generating components is avoided, which is conducive to further reducing an influence of heat generated by a heat source on the device.

A plurality of sound reception holes are arranged, and the plurality of sound reception holes are evenly distributed along a circumferential direction of the bottom cover 160, so as to ensure an effect of sound collecting. In one specific instance, six sound reception holes are arranged.

In other optional embodiments, the device further includes: a base 170 having elasticity and connected with the bottom cover 160; and a back glue 180 located between the base 170 and the bottom cover 160 and reinforcing a connection between the base 170 and the bottom cover 160. An example is shown in FIG. 9.

In practical application, the base 170 is located at a lowest side of the device, has a supporting effect for the bottom cover 160, the shell 120 and the hollow piece 131, and is used for making contact with supporting faces such as a tabletop. The base 170 with elasticity is located at a bottom of the bottom cover 160, has an antiskid effect, and is good in wear-resisting effect. In addition, the base 170 can reduce vibration of the device generated in a using process, and reduce an influence of a vibration sound.

The back glue 180 includes solid double-faced adhesive tape, or a colloid formed by solidifying a liquid bonding agent. The back glue 180 is used for fixing the base 170 on the bottom cover 160.

In other optional embodiments, the device further includes: a touch control bracket 190 connected with a top cover 132 of the sound-producing structure and located above the hollow piece 131, including a touch control region; and a touch control module 210 installed on the touch control bracket 190 and configured to detect a touch control operation acting on the touch control region and form an electrical signal corresponding to the touch control operation. The heat-generating component 250 at least includes: a processing module. The processing module is electrically connected with the touch control module 210, and is configured to control, according to the electrical signal, a sound-producing piece to play an audio.

Without limitation, the touch control module 210 includes a touch control circuit.

Figure 6:
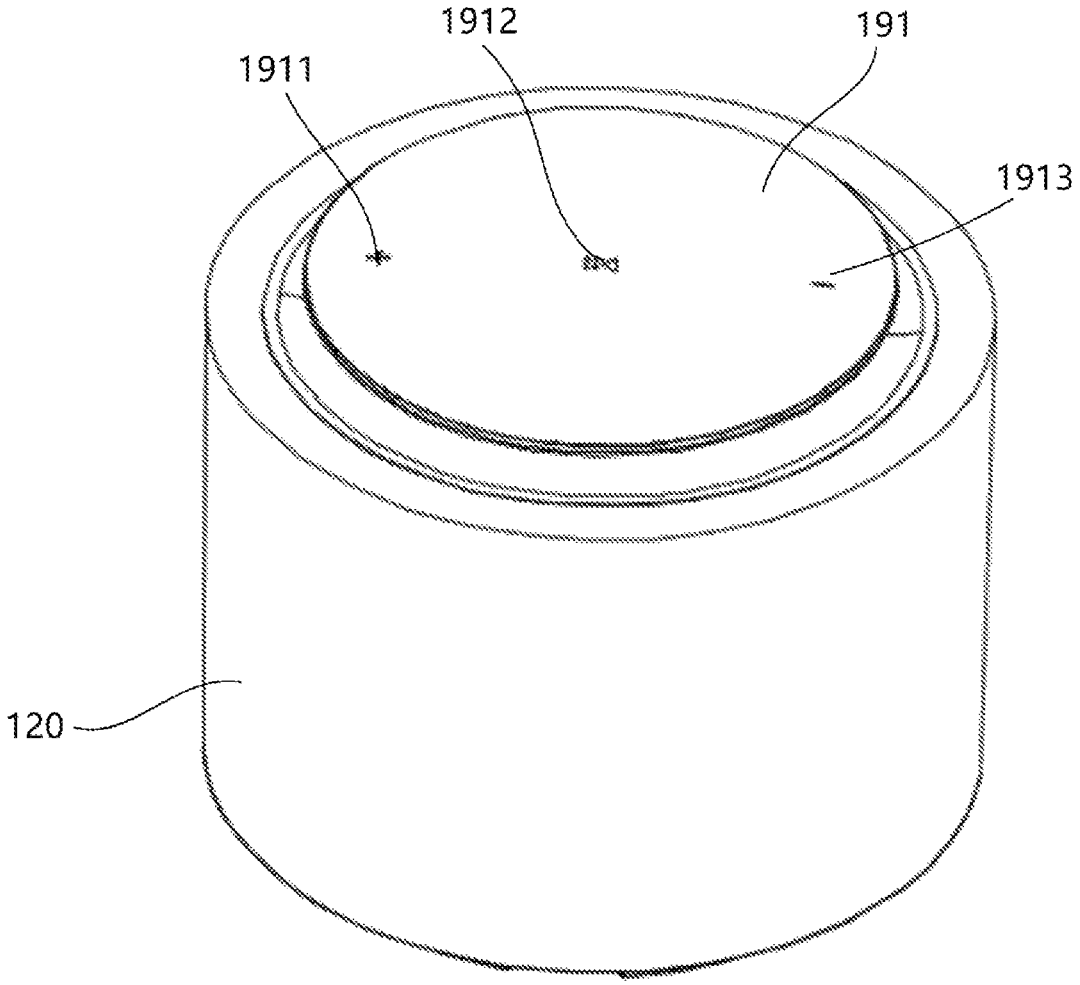
FIG. 6 is a second schematic structural diagram of a playback device illustrated according to an embodiment.

Without limitation, as shown in FIG. 9 the touch control region is located at a top face of the touch control bracket 190. As shown in FIG. 6, the touch control region includes a volume plus touch control region 1911, a volume minus touch control region 1913 and a pause touch control region 1912.

The touch control bracket 190 is arranged above the top cover 132, so as to facilitate operation.

In other optional embodiments, the device further includes: a light source 260 installed on the touch control bracket 190; and a light emitting module 221 electrically connected to the light source 260 and the processing module respectively and configured to control the light source 260 to emit light.

The light emitting module 221 can improve a light effect of the device, and enrich functions of the device. For instance: the processing module may control the light emitting module 221 to emit light while controlling the sound-producing piece to play the audio, so as to improve a using experience of the device.

Without limitation, the light emitting module 221 includes a light emitting control circuit.

In other optional embodiments, the touch control bracket 190 includes: a touch control upper cover 191 having the touch control region; and a touch control lower cover 192 located below the touch control upper cover 191, installed on the top cover 132, and forming an accommodating cavity with the touch control upper cover 191. The accommodating cavity accommodates the light source 260, the light emitting module 221 and the touch control module 210. A side face of a cavity wall of the accommodating cavity is a light transmitting face.

The touch control upper cover 191 and the touch control lower cover 192 jointly form the sealed accommodating cavity, which has a protective effect on the light source 260, the light emitting module 221 and the touch control module 210. The light transmitting face enables light to diverge along a preset direction, thus improving the using experience.

As shown by arrow in FIG. 5, the side face of the cavity wall is the light transmitting face, so the light generated by the light source 260 diverges along the cavity wall of the accommodating cavity.

Without limitation, as shown in FIG. 7, an outer diameter of the touch control lower cover 192 is gradually increased from bottom to top, roughly presenting a shape of an opened umbrella.

In other optional embodiments, as shown in FIG. 9, the touch control bracket 190 further includes a colloid 200, the colloid 200 is located between the touch control upper cover 191 and the touch control lower cover 192, fixes the touch control upper cover 191 and the touch control lower cover 192, and seals a seam between the touch control upper cover 191 and the touch control lower cover 192.

The colloid 200 is used for connecting the touch control upper cover 191 and the touch control lower cover 192, so as to ensure firmness of a connection between the touch control upper cover 191 and the touch control lower cover 192. The colloid 200 can also seal the seam between the touch control upper cover 191 and the touch control lower cover 192, so as to ensure a liquid sealing effect of a first accommodating cavity, thus improving the protective effect on the light source 260, the light emitting module 221 and the touch control module 210.

The colloid 200 may be double faced adhesive tape, which is an example and not intended to be limiting.

In other optional embodiments, the top cover 132 of the sound-producing structure is located between the shell 120 and the touch control lower cover 192, and an interval exists between the top cover 132 and the touch control lower cover 192.

Due to the interval between the top cover 132 and the touch control lower cover 192, an effect of the touch control bracket 190 being "floated" above the shell 120 is achieved, as shown in FIG. 5, which is conducive to further improving the using experience of the device.

In other optional embodiments, as shown in FIG. 8, the shell 120 includes a limiting protrusion 121 protruding towards a direction of the bottom cover 160.

The limiting protrusion 121 is located between the bottom cover 160 and the bracket 110 of the sound-producing structure and limits the shell 120 from separating from the bracket 110.

As shown in FIG. 7 and FIG. 8, the bracket 110 abuts against a top face of the limiting protrusion 121, and limits the shell 120 from moving upward along an axial direction of the shell 120; and the bottom cover 160 abuts against a bottom face of the limiting protrusion 121, and limits the shell 120 from moving downward along the axial direction of the shell 120. Through limiting effects of the bracket 110 and the bottom cover 160 on the limiting protrusion 121, installation reliability of the shell 120 is ensured.

In practical application, the bottom cover 160 may be in sleeve connection with the limiting protrusion 121. As shown in FIG. 7 and FIG. 8, the bottom cover 160 is sleeved outside the limiting protrusion 121 to further enhance fixation on the shell 120. For instance: the bottom cover 160 is in interference fit with the limiting protrusion 121 of the hollow shell 120, so as to further limit the shell 120 from separating from the bottom cover 160, thus ensuring integrity of the playback device.

In one specific instance, the playback device is a speaker. As shown in FIG. 9, the speaker sequentially includes: the touch control upper cover 191, a touch control FPC (flexible printed circuit, i.e. the touch control module 210), the colloid 200, the light emitting module 221, the light source 260, the touch control lower cover 192, the top cover 132, the hollow piece 131, the bracket 110, the shell 120, the heat dissipation piece 150, heat conducting glue 230, a master chip, the bottom cover 160, the back glue 180, the base 170 and a nameplate 240. A top face of the touch control upper cover 191 has a texture, the texture may be a CD (compact disk)-like texture, and the top face of the touch control upper cover 191 as shown in FIG. 6 has a volume plus touch control region 1911, a volume minus touch control region 1913 and a pause touch control region 1912. The touch control FPC is fixed on the touch control upper cover 191 through the colloid 200 and is electrically connected with the light emitting module 221. The light emitting module 221 and the light source 260 may both be installed on a light board PCBA 220 (printed circuit board assembly). The light board PCBA 220 is electrically connected to a master chip (also a PCBA board), the master chip includes at least part of the processing module, the touch control module 210 is electrically connected to the processing module through the light board PCB board, and the master chip may be fixed on the bracket 110. The touch control lower cover 192 and the touch control upper cover 191 form a closed lamp environment (i.e., the accommodating cavity) to reduce light leakage. At the same time, the touch control lower cover 192 supports the touch control upper cover 191, and may be physically connected to the touch control upper cover 191 by screws. The top cover 132 is placed above the shell 120 and is physically connected to the touch control lower cover 192 and the hollow piece 131 by screws respectively. The bracket 110 is physically connected to the hollow piece 131 by screws, and cooperates with a bottom step (i.e., the limiting protrusion 121) of the shell 120 to limit the shell 120. The shell 120 is roughly in a cylindrical shape and serves as an external machine body of the speaker. The heat dissipation piece 150 performs heat dissipation on the heat-generating components 250 through the heat conductive glue 230, and may be fixed on an outer wall of the hollow piece 131 through double faced adhesive tape. The bottom cover 160 may cover the master chip, and is physically connected with the bracket 110 by screws. The nameplate 240 may be installed on the base 170 for recording product information of the speaker. The speaker of the embodiment of the disclosure realizes top touch control and top side lighting, the shell 120 is cylindrical, the bottom of the device has 6 sound reception holes evenly spaced, and a whole structure has high reliability.

Features disclosed in the several device embodiments provided by the disclosure can be arbitrarily combined under the condition of no conflict to obtain a new device embodiment.

After considering the specification and practicing the disclosure disclosed herein, those of skill in the art will easily think of other implementation schemes of the disclosure. The disclosure is intended to cover any variations, uses, or adaptive changes of the disclosure. These variations, uses, or adaptive changes follow the general principles of the disclosure and include common knowledge or conventional technical means in the technical field that are not disclosed in the disclosure.

It can be understood that the disclosure is not limited to the precise structure that has been described above and shown in the drawings, and various modifications and changes can be made without departing from its scope. The scope of the present disclosure is only limited by the appended claims.

Additional non-limiting embodiments of the disclosure include:

1. A sound-producing structure, including: a hollow piece; a sound-producing piece located in a hollow cavity of the hollow piece; and a heat dissipation piece located outside the hollow cavity, a first part of the heat dissipation piece being located below the hollow piece and a second part of the heat dissipation piece being on a side wall of the hollow piece.

2. The structure of embodiment 1, where the structure further includes: a heat source seat located below the hollow piece; and a heat-generating component located on the heat source seat; where the first part of the heat dissipation piece is located on the heat source seat.

3. The structure of embodiment 2, where the heat dissipation piece has a boss protruding towards the heat-generating component.

4. The structure of embodiment 3, where the structure further includes: heat conducting glue located between the boss and the heat source seat.

5. The structure of any of embodiments 1 to 4, where the structure further includes: a top cover located above the hollow piece and covering the hollow cavity.

6. A playback device, including: a sound-producing structure including: a hollow piece; a sound-producing piece located in a hollow cavity of the hollow piece; and a heat dissipation piece located outside the hollow cavity, a first part of the heat dissipation piece being located below the hollow piece and a second part of the heat dissipation piece being located on a side wall of the hollow piece; and a bracket located below the heat dissipation piece of the sound-producing structure, the hollow piece of the sound-producing structure being located on the bracket.

7. The device of embodiment 6, where the device further includes: a shell located on the bracket; where the shell has a cavity, the hollow piece is located in the cavity, and a second part of the heat dissipation piece is located between the hollow piece and an inner wall of the shell.

8. The device of embodiment 7, where the device further includes: a heat source seat located below the hollow piece; a heat-generating component located on the heat source seat, the first part of the heat dissipation piece being located on the heat source seat; and a bottom cover, the bottom cover and the bracket being located on two sides of a heat source seat of the sound-producing structure respectively, a side face of the bottom cover having a sound reception hole; and the heat-generating component at least includes: an audio collecting module configured to collect a sound passing the sound reception hole.

9. The device of embodiment 8, where the device further includes: a base having elasticity and connected with the bottom cover; and back glue located between the base and the bottom cover and reinforcing a connection between the base and the bottom cover.

10. The device of embodiments 8 or 9, where the device further includes: a touch control bracket, connected with a top cover of the sound-producing structure, located above the hollow piece, and including a touch control region; and a touch control module, installed on the touch control bracket, and configured to detect a touch control operation acting on the touch control region and form an electrical signal corresponding to the touch control operation; where the heat-generating component at least comprises a processing module, the processing module is electrically connected with the touch control module, and is configured to control, according to the electrical signal, a sound-producing piece to play an audio.

11. The device of embodiment 10, where the device further includes: a light source installed on the touch control bracket; and a light emitting module, electrically connected to the light source and the processing module respectively, and configured to control the light source to emit light.

12. The device of embodiment 11, where the touch control bracket includes: a touch control upper cover having the touch control region; and a touch control lower cover, located below the touch control upper cover, installed on the top cover, and forming an accommodating cavity with the touch control upper cover; where the accommodating cavity accommodates the light source, the light emitting module and the touch control module; and a side face of a cavity wall of the accommodating cavity is a light transmitting face.

13. The device of embodiment 12, where the touch control bracket further includes: a colloid, located between the touch control upper cover and the touch control lower cover, fixing the touch control upper cover and the touch control lower cover, and sealing a seam between the touch control upper cover and the touch control lower cover.

14. The device of embodiments 12 or 13, where the top cover of the sound-producing structure is located between the shell and the touch control lower cover, and an interval exists between the top cover and the touch control lower cover.

15. The device of any of embodiments 8 to 14, where the shell includes: a limiting protrusion protruding towards a direction of the bottom cover; where the limiting protrusion is located between the bottom cover and the bracket of the sound-producing structure and limits the shell from separating from the bracket.

What is claimed is:

1. A playback device, comprising:

a sound-producing structure; wherein, the sound-producing structure comprises:

a hollow piece;

a sound-producing piece located in a hollow cavity of the hollow piece;

a heat dissipation piece located outside the hollow cavity, a first part of the heat dissipation piece being located below the hollow piece and a second part of the heat dissipation piece being located on a side wall of the hollow piece; and a top cover located above the hollow piece;

a bracket located below the heat dissipation piece of the sound-producing structure, the hollow piece of the sound-producing structure being located on the bracket; and a touch control bracket, connected with the top cover, located above the hollow piece, and comprising:

a touch control upper cover having the touch control region; and a touch control lower cover, located below the touch control upper cover, installed on the top cover, and forming an accommodating cavity with the touch control upper cover, wherein the accommodating cavity accommodates a light source and a light emitting module electrically connected to the light source.

2. The device according to claim 1, wherein the device further comprises:

a shell located on the bracket;

wherein the shell has a cavity, the hollow piece is located in the cavity, and a second part of the heat dissipation piece is located between the hollow piece and an inner wall of the shell.

3. The device according to claim 2, wherein the device further comprises:

a heat source seat located below the hollow piece;

a heat-generating component located on the heat source seat, the first part of the heat dissipation piece being located on the heat source seat; and a bottom cover, the bottom cover and the bracket being located on two sides of a heat source seat of the sound-producing structure respectively, a side face of the bottom cover having a sound reception hole; and the heat-generating component at least comprises:

an audio collecting module configured to collect a sound passing the sound reception hole.

4. The device according to claim 3, wherein the device further comprises:

a base having elasticity and connected with the bottom cover; and back glue located between the base and the bottom cover and reinforcing a connection between the base and the bottom cover.

5. The device according to claim 3, wherein the device further comprises:

a touch control module, located in the accommodating cavity, and configured to detect a touch control operation acting on the touch control region and form an electrical signal corresponding to the touch control operation; wherein the heat-generating component at least comprises a processing module, the processing module is electrically connected with the touch control module, and is configured to control, according to the electrical signal, a sound-producing piece to play an audio.

6. The device according to claim 5, wherein the light emitting module is electrically connected to the processing module, and configured to control the light source to emit light.

7. The device according to claim 3, wherein the shell comprises:

a limiting protrusion protruding towards a direction of the bottom cover;

wherein the limiting protrusion is located between the bottom cover and the bracket of the sound-producing structure and limits the shell from separating from the bracket.

8. The device according to claim 1, wherein the touch control bracket further comprises:

a colloid, located between the touch control upper cover and the touch control lower cover, fixing the touch control upper cover and the touch control lower cover, and sealing a seam between the touch control upper cover and the touch control lower cover.

9. The device according to claim 1, wherein the top cover of the sound-producing structure is located between the shell and the touch control lower cover, and an interval exists between the top cover and the touch control lower cover.

* * * * *